US005527153A

United States Patent [19]

Bernhardt

[11] Patent Number: 5,527,153

[45] Date of Patent: Jun. 18, 1996

[54] VARIABLE PITCH PROPELLER

[76] Inventor: David L. Bernhardt, 6333 Porteridge La., Canton, Mich. 48170

[21] Appl. No.: 195,929

[22] Filed: Feb. 14, 1994

[51] Int. Cl.[6] ..... F04D 29/18

[52] U.S. Cl. ..... 416/46; 416/89; 416/153

[58] Field of Search ..... 416/46, 89, 93 A, 416/134, 147, 153, 167

[56] References Cited

U.S. PATENT DOCUMENTS

| | | | |
|---|---|---|---|
| 2,998,080 | 8/1961 | Moore, Jr. | 416/89 |
| 4,599,043 | 7/1986 | Muller | 416/93 A |
| 4,792,279 | 12/1988 | Bergeron | 416/89 |
| 4,826,404 | 5/1989 | Zwicky | 416/134 |
| 5,022,820 | 6/1991 | Bergeron | 416/89 |
| 5,129,785 | 7/1992 | Speer | 416/46 |
| 5,232,345 | 8/1993 | Rocco | 416/153 |
| 5,252,028 | 10/1993 | LoBosco et al. | 416/134 R |
| 5,326,223 | 7/1994 | Speer | 416/46 |

*Primary Examiner*—John T. Kwon
*Attorney, Agent, or Firm*—Charles W. Chandler

[57] ABSTRACT

A variable pitch propeller assembly is disclosed for a power boat. Three blades are mounted on a housing carried by the propeller shaft. Each blade has an axle received in the housing. Each axle has a slot receiving a dowel carried in the housing so the blade can rotate about 5° between two pitch positions. A centrifugally-operated, spring biased latch carried in the housing locks the shaft in each pitch position. The blade is released from the latch by a predetermined change in the hydrodynamic force acting on the blade surface. The propeller shaft is connected to the propeller assembly by three plastic keys which shear to permit the propeller assembly to spin with respect to the propeller shaft when the propeller assembly strikes a predetermined resistance, such as a rock or the like.

8 Claims, 4 Drawing Sheets

VARIABLE PITCH PROPELLER

BACKGROUND OF THE INVENTION

This invention is related to marine propeller assemblies having a variable pitch, and more particularly to such a propeller assembly having blades moved by hydrodynamic force from a low pitch at relatively low speeds, to a higher pitch when the boat is on plane. A centrifugally-operated latch locks the blades in position at each pitch.

U.S. Pat. No. 5,022,820 which was issued on Jun. 11, 1991, and U.S. Pat. No. 4,792,279 which was issued on Dec. 20, 1988, both to Robert M. Bergeron, disclose automatic, variable pitch propellers for pleasure boats in which a central hub has openings for receiving the axle of three propeller blades. Each blade is moved in its opening and rotated by employing centrifugal force acting on the propeller as the propeller shaft increases its rotation. They do not appear to effectively accommodate the necessary torque loads that occur as a boat goes on plane.

Another problem with pleasure boats is that occasionally the propeller strikes an object in shallow water. The shock damages the propeller shaft. Replacing the propeller shaft and other drive components is expensive.

SUMMARY OF THE INVENTION

The broad purpose of the present invention is to provide a variable pitch propeller which initially maintains a constant pitch as the shaft rotation increases and then automatically changes pitch at a higher shaft rotation.

The preferred propeller assembly comprises a housing mounted on the propeller shaft. The housing has three openings, one for each of three propeller blades. Each propeller blade has an axle received in its opening so that the blade can rotate about 5°, or any other suitable range, between a low pitch position and a high pitch position. Each blade axle has an internal slot that receives a pin to define the range of rotation of the axle.

A timing ring is mounted in the housing and connected to the three blade axles so they change pitch together. A centrifugally-operated, spring-biased latch responds to a change in shaft rotation to lock the timing ring with the blades in either a high pitch position or a low pitch position.

The propeller housing is connected to the shaft by a bushing. The bushing is internally splined to mate with a splined section of the propeller shaft. The outer cylindrical surface of the bushing has three semi-cylindrical recesses extending parallel to the shaft. The housing has an annular section which receives the splined hub. The annular section has three semi-cylindrical openings facing the corresponding openings in the hub. Three plastic keys, about 1" long, and about ⅜" in diameter are seated in the opposed semi-cylindrical openings.

When the propeller assembly encounters a predetermined resistance, the propeller housing rotates with respect to the shaft by shearing the keys, to protect the shaft from damage. The plastic keys also provide a cushioning effect as well as an electrical insulation advantage. Upon shearing, the propeller assembly can easily be field-repaired by the simple replacement of the elastomer keys, using only the tools required to remove the propeller assembly from the propeller shaft.

Still further objects and advantages of the invention will become readily apparent to those skilled in the art to which the invention pertains.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
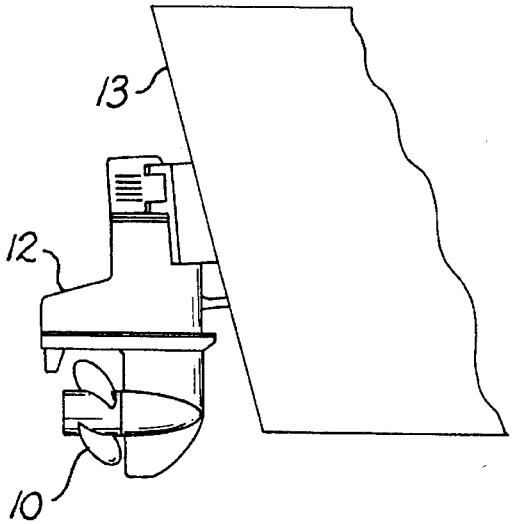
FIG. 1 shows a boat having a propeller assembly illustrating the preferred embodiment of the invention.
Figure 2:
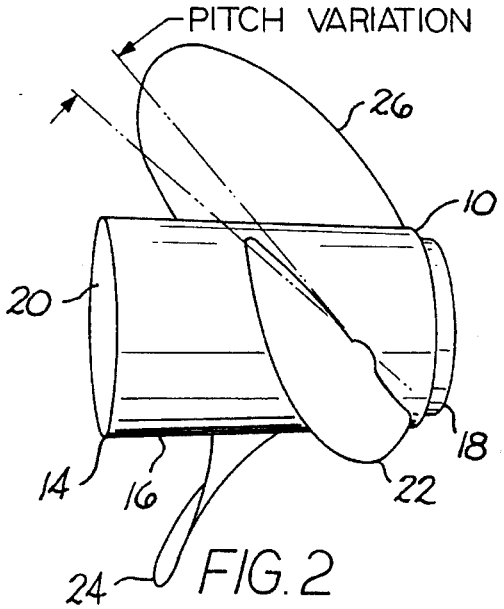
FIG. 2 is an enlarged view showing the manner in which the blades automatically change their pitch with respect to the propeller housing.

FIGS. 1 and 2 illustrate a preferred propeller assembly 10 mounted on the outdrive 12 of a recreational marine boat 13. The propeller assembly is connected to a marine engine, not shown, which drives the propeller assembly.

Figure 3:
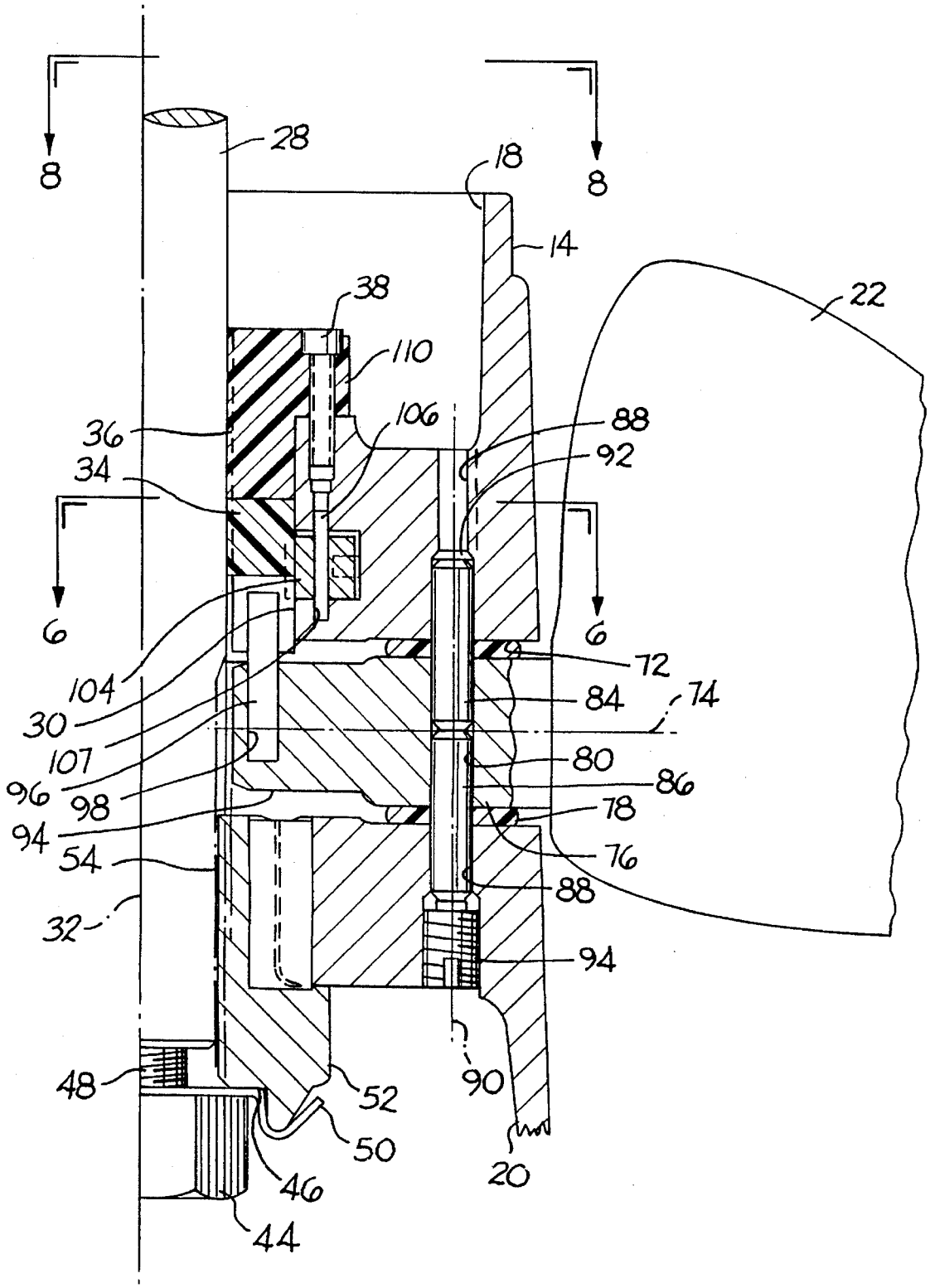
FIG. 3 is a longitudinal, sectional view through the propeller housing to show a typical mechanism for changing the blade pitch.

The propeller assembly comprises an elongated hollow housing 14 preferably having a frusto-conical outer surface 16 with a forward inlet opening 18. The housing diameter is gradually enlarged to an outlet opening 20 having a somewhat larger diameter. The propeller assembly has three variable pitched blades 22, 24 and 26. The three blades are identical, and are located about the axis of the housing, 120° apart. The axis of the housing coincides with the axis of propeller shaft 28, illustrated in FIG. 3. The mechanism for controlling the pitch of each blade is identical. A typical mechanism is illustrated in FIG. 3.

Housing 14 has an internal longitudinal bore 30. Bore 30 is formed about a longitudinal axis that coincides with axis 32 of propeller shaft 28. A timing ring 34 is rotatably, slideably mounted in bore 30 for a purpose which will be described. A very high molecular weight polyethylene plastic annular thrust cap 36 is mounted at the inlet end of the bore. Three metal threaded fasteners 38 attach thrust cap 36 to the inlet end of the bore.

A nut 44 is mounted in a recessed shoulder 46 at the opposite end of the housing, on a threaded section 48 on the end of the drive shaft. A retainer 50 is mounted beneath the head of the nut and bent around a slot on hub 52 to prevent the nut from becoming loose.

The shaft has an elongated, externally splined section 54.

Figure 11:
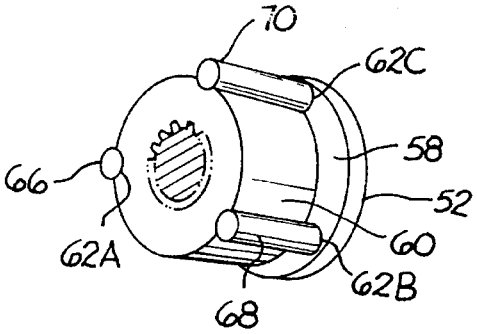
FIG. 11 is a view showing the shear pin hub.

Referring to FIGS. 3 and 11, hub 52 is preferably formed of aluminum and has an internally splined bore 56 which mates with the splines on the shaft as the hub is slideably, longitudinally mounted on the end of the shaft. The hub has a shoulder 58 which abuts the outer end of bore 30 to define the position of the hub in the housing. Hub 52 rotates with the shaft.

Figure 10:
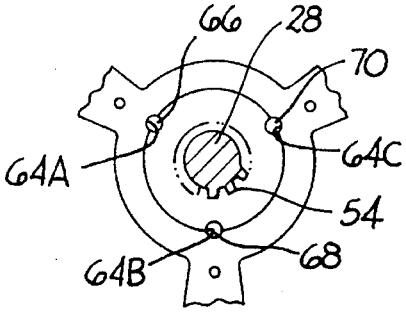
FIG. 10 is shows the position of the shear pin between the propeller shaft and the propeller housing.

Referring to FIGS. 10 and 11, the hub has a cylindrical section 60 with three semi-cylindrical, elongated recesses 62A, 62B and 62C. The housing bore has three inwardly facing recesses 64A, 64B and 64C. These recesses are also semi-cylindrical and have a length generally corresponding to the length of recesses 62A, 62B and 62C. Three shear pins 66, 68 and 70 are mounted in the recesses. Pin 66 is mounted in recesses 62A and 64B, pin 68 is mounted in recesses 62B and 64B and pin 70 is mounted in recesses 62C and 64C. For illustrative purposes, the keys are about 1" long and ⅜" diameter. Preferably, the pins are also of a slightly resilient polyethylene material.

The material and size of the keys are chosen to accommodate the maximum torque expected to be transmitted between the propeller assembly and the shaft. The keys are designed with a maximum shear strength chosen to prevent damage to the propeller assembly and the shaft should the propeller assembly strike an object in the water.

Referring to FIG. 3, the housing has three cylindrical openings, only one shown, located 120° apart around the propeller shaft axis. Opening 72 is typical of the three. Opening 72 is formed about an axis 74 at right angles to propeller shaft axis 32. Blade 22 has a generally cylindrical axle 76 slideably received in a plastic annular bushing 78 in opening 72. The blade axle is rotatable about axis 74.

Figure 7:
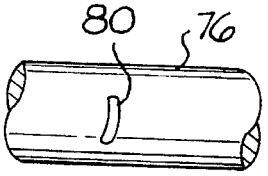
FIG. 7 is a view illustrating the slot in the axle.
Figure 8:
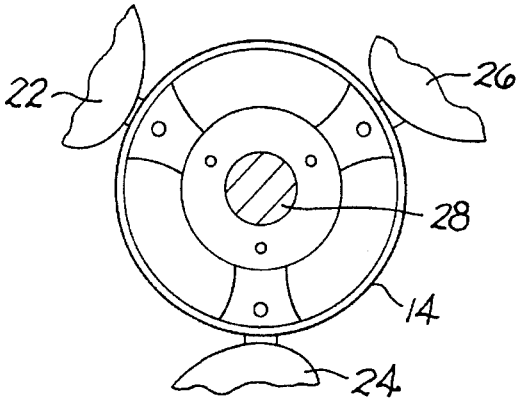
FIG. 8 is an fragmentary end view of the propeller shaft from the forward end of the housing.
Figure 9:
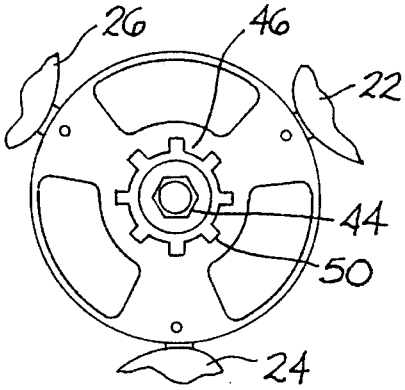
FIG. 9 is a fragmentary view looking at the propeller assembly from the rear end of the housing.

Axle 76 has a transverse short slot 80. As illustrated in FIG. 7, slot 80 extends between opposite sides of the axle.

Referring to FIG. 3, a pair of dowels 84 and 86 (or optionally a single dowel equal to the length of the two) are mounted in dowel opening 88 in the housing. Axis 90 of the dowel opening is parallel to the propeller shaft axle. The two dowels are inserted in the dowel opening until they bottom at shoulder 92. A set screw 94 mounted in the inlet threaded end of opening 88 locks the dowels in position. The adjacent ends of the dowels are received in axle slot 80.

The two dowels define the range of rotation of the propeller axle as it is rotated by the hydrodynamic force of the water in which the boat is moving. The arrangement is such that the two dowels abut one end of slot 80 when the propeller blade is at rest at an initial low pitch position. The blade can rotate 5° until the dowels abut the opposite end of the slot, to a different pitch.

The blade axle has a narrowed inner end 94.

A timing pin 96 is mounted in an opening 98 in the axle, and extends at right angles to the axle, and generally parallel to the propeller shaft axis. Pin 96 rotates with the axle.

Figure 4:
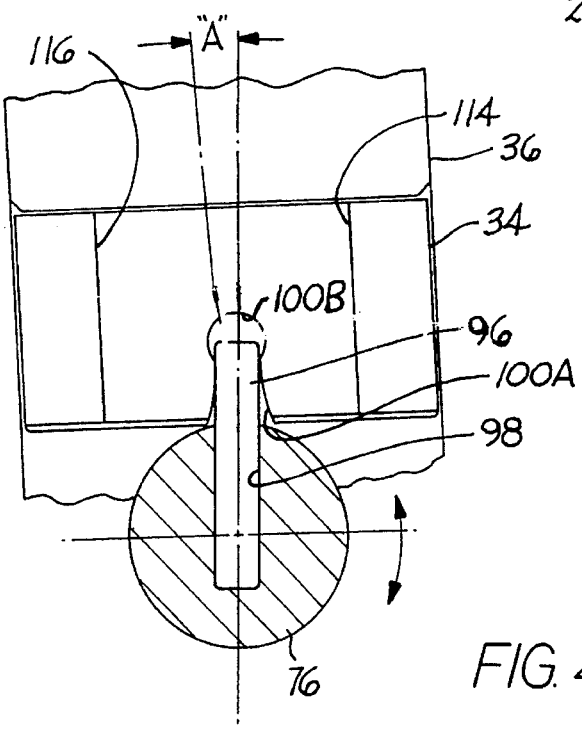
FIG. 4 is a view showing the connection between a typical propeller axle and the timing ring.

FIG. 4 is an enlarged view of the timing ring to show the manner in which the end of the timing pin is received in typical slot 100. Slot 100 extends from the inner cylindrical surface to the outer cylindrical surface of the ring and has "V" shaped sidewalls 100A and a semi-cylindrical base 100B. The slot shape accommodates the motion of the timing pin as it rotates about axis 74 with the axle, and also to accommodate the relative motion between the timing pin and the timing ring. Thus, as the propeller blade axle swings through an arc defined by slot 80, the timing pin swings through an arc "A".

The timing ring has two other slots. The three slots are located 120° apart around the propeller shaft axis to accommodate the timing pins of the other two blade mechanisms. The ring causes the three blades to change pitch together.

Figure 5:
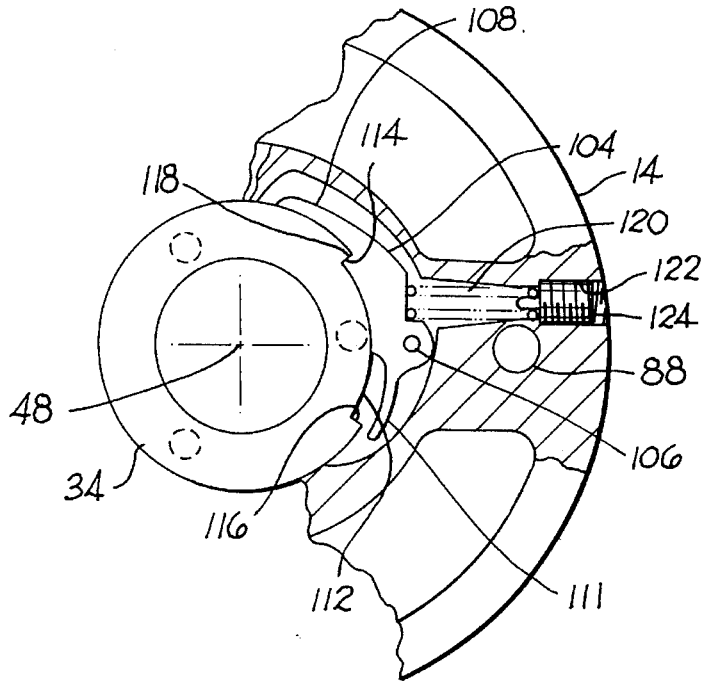
FIGS. 5–6 show the relationship between the timing ring and the centrifugally operated latch, generally as seen along lines 6—6 of FIG. 3.
Figure 6:
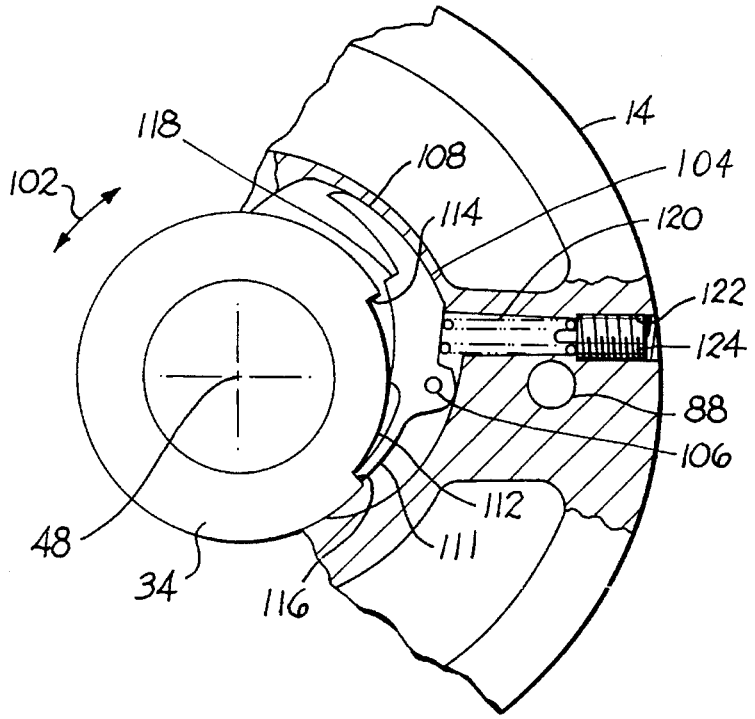

Referring to FIGS. 4, 5 and 6, the timing ring is rotatable about the axis of the propeller shaft in a direction generally indicated at 102. An elongated latch 104 is pivotally mounted on a pivot pin 106. Pivot pin 106 is mounted in an opening 107 in the housing, parallel to propeller shaft axis 48. A screw 110 is used to retain the pin in the latch as illustrated in FIG. 3. The latch has a long end 108 and a short end 111. The two ends have a finger-shaped configuration embracing the timing ring.

The timing ring has a curved peripheral slot 112. The ends of the slot terminate in a pair of shoulders 114 and 116. The distance between the shoulders is a function of the rotational travel of the timing ring. For example, assuming the axle is to rotate a distance of about 5°, the length of the slot will be in an arc 69.75° about propeller shaft axis 48. The long end of the latch has a shoulder 118 that abuts shoulder 114 in the position illustrated in FIG. 5. The distance between the extreme end of the short end of the latch and shoulder 118 is about 75°.

The long end of the latch has a weight chosen so as to be responsive to the centrifugal force acting on the latch as the propeller shaft housing is being rotated by the propeller shaft. A spring 120 is seated in opening 122. A set screw 124 closes off spring opening 122. Spring 120 biases the latch toward the latched position illustrated in FIG. 5, in which seat 118 abuts end 114 of the slot and locks the timing ring and thus the blades in a position preventing relative movement between the blades and the propeller housing in their low pitch position. This position corresponds to the position of dowels 84 and 86 when they abut one end of slot 88.

The weight of the long end of the latch and the bias of the spring is chosen so that at a certain increased propeller shaft r.p.m., the centrifugal force acting on the latch causes it to pivot in a clockwise direction, as viewed in FIG. 5, so that the latch overcomes the bias of the spring. Shoulder 118 separates from shoulder 114 thus permitting the timing ring to rotate in the clockwise direction. The hydrodynamic force acting on the propeller blades rotates the blades about their respective axles together with the timing ring until dowels 84 and 86 abut the opposite end of slot 80. The increased centrifugal force pivots the latch in the clockwise direction until the smaller end of the latch moves into timing ring slot 112 and abuts shoulder 116 thereby preventing the timing ring from rotating in the counter clockwise direction or vibrating in its latched position.

As the propeller shaft slows down to a predetermined rotational rate, the centrifugal force acting on the large end of the latch is reduced until spring 120 pivots the latch in the counter clockwise direction thereby causing the smaller end of the latch to disengage from shoulder 116. The timing ring and the blades are then rotated to their opposite pitch position defined by slot 80 by the hydrodynamic force acting on the blade surface at a different effective position corresponding to the new shaft r.p.m. Latch shoulder 118 then moves into slot 112 and engages shoulder 114 of the slot to prevent the timing ring from rotating in the clockwise direction until there has been an appropriate increase in the propeller shaft rotation.

Thus it is to be understood that I have described a propeller shaft arrangement having shear pins that prevent damage to the propeller shaft when the propeller blades strike an object in the water. Further I have described a latch mechanism that locks the propeller blades in either of two pitch positions depending upon the rotational rate of the propeller shaft.

Having described my invention, I claim:

1. A variable pitch propeller assembly for a boat having drive means, and a propeller shaft rotated by the drive means at a variable r.p.m. about a propeller shaft axis, comprising:

a housing, and means for mounting the housing on the shaft for rotation therewith;

the housing having an axle opening;

a propeller blade having an axle mounted in the axle opening so as to be rotatable between a first pitch position and a second pitch position;

a timing ring mounted about the propeller shaft so as to be rotatable with respect to the housing between a first timing position and a second timing position;

timing structure connecting the propeller blade axle to the timing ring such that the timing ring is rotated from said first timing position to said second timing position as the axle is rotated;

a latch;

means pivotally mounting the latch on the housing adjacent the timing ring for motion toward a latching position in which the latch engages the timing ring to prevent rotation of the timing ring from the first timing position toward the second timing position, the latch being movable to a release position permitting rotation of the timing ring toward the second timing position;

the latch being biased toward said latching position by centrifugal force as a function of the rate of rotation of the shaft;

bias means mounted on the housing for biasing the latch toward said release position;

whereby as the propeller blade moves through a body of water, the latch pivots under the influence of centrifugal force at a predetermined r.p.m. from the latching position and toward the release position to permit the propeller blade axle to change the pitch of the propeller blade with respect to the housing.

2. A variable pitch propeller as defined in claim 1, in which the latch is pivotal in a first direction to engage the timing ring in said first latching position, and pivotal in the opposite direction to engage the timing ring in a second latching position.

3. A variable pitch propeller as defined in claim 1, in which the timing ring has a shoulder engageable with the latch in said first latching position whereby the latch prevents rotation of the timing ring in a first direction.

4. A variable pitch propeller assembly as defined in claim 3, in which the timing ring has a second shoulder and the latch is pivoted to a second position engaging the second shoulder to prevent rotation of the timing ring in the opposite direction.

5. A variable pitch propeller assembly as defined in claim 1, in which the latch is pivoted about an axis generally parallel to the propeller shaft axis.

6. A variable pitch propeller assembly as defined in claim 1, including a second propeller blade having an axle, and structure connecting the second propeller axle to the timing ring whereby the first and the second propeller blades rotate together to change their respective pitches as the timing ring is being rotated.

7. A variable pitch propeller assembly as defined in claim 1, in which the timing ring has a slot, and including a pin carried on the axle and received in the timing ring slot such that the axle rotates the timing ring about the propeller shaft axis.

8. A combination, comprising:

a boat having drive means, and a propeller shaft rotated by the drive means at a variable r.p.m. about a propeller shaft axis, the propeller shaft having longitudinal external spline means;

a housing, and means for mounting the housing on the propeller shaft for rotation therewith;

the housing having an axle opening;

a propeller blade having an axle mounted in the axle opening so as to be rotatable with respect to the housing between a first pitch position and a second pitch position, and the propeller blade being rotatable with the housing and the propeller shaft;

a timing ring mounted about the propeller shaft so as to be rotatable with respect to the housing between a first timing position and a second timing position;

timing structure connecting the propeller blade axle to the timing ring such that the timing ring is rotated from said first timing position to said second timing position as the axle is rotated;

a latch;

means pivotally mounting the latch on the housing adjacent the timing ring for motion toward a latching position in which the latch engages the timing ring to prevent rotation of the timing ring from the first timing position toward the second timing position, the latch being movable to a release position permitting rotation of the timing ring toward the second timing position;

the latch being biased toward said latching position by centrifugal force as a function of the rate of rotation of the propeller shaft;

bias means mounted on the housing for biasing the latch toward said release position;

whereby as the propeller blade moves through a body of water, the latch pivots under the influence of centrifugal force at a predetermined r.p.m. from the latching position and toward the release position to permit the propeller blade axle to change the pitch of the propeller blade with respect to the housing;

a metal hub having an internal spline means mounted on the propeller shaft with the hub spline means engaged with the propeller spline means such that the hub is rotatable with the propeller shaft;

said housing having a bore for receiving the hub;

the hub and the housing having confronting openings; and a plastic shear key disposed in the confronting openings such that the hub and the blade rotate together unless a predetermined resistance causes the hub to move with respect to the housing so as to shear the key.

* * * * *